US007557255B2

(12) United States Patent
Wolf et al.

(10) Patent No.: US 7,557,255 B2
(45) Date of Patent: Jul. 7, 2009

(54) METHOD AND AN UNLEADED LOW EMISSION GASOLINE FOR FUELING AN AUTOMOTIVE ENGINE WITH REDUCED EMISSIONS

(75) Inventors: Leslie R. Wolf, Naperville, IL (US); Thomas J. Bond, Chardon, OH (US); Gerald S. Lane, Naperville, IL (US); James J. Simnick, Naperville, IL (US); Douglas N. Rundell, Glen Ellyn, IL (US); Frank S. Gerry, Aurora, IL (US); Robert J. Schaefer, Darien, IL (US); James P. Uihlein, Fallbrook, CA (US); Frank J. Sroka, Glencoe, IL (US); Allen A. Kozinski, Incline Village, NV (US); F. Lindsey Scott, Plano, TX (US); Richard A. Kretchmer, Claredon Hills, IL (US)

(73) Assignee: BP Corporation North America Inc., Warrenville, IL (US)

( * ) Notice: Subject to any disclaimer, the term of this patent is extended or adjusted under 35 U.S.C. 154(b) by 379 days.

(21) Appl. No.: 10/137,162

(22) Filed: May 2, 2002

(65) Prior Publication Data

US 2003/0046862 A1 Mar. 13, 2003

Related U.S. Application Data

(60) Provisional application No. 60/288,054, filed on May 2, 2001, provisional application No. 60/288,142, filed on May 2, 2001.

(51) Int. Cl.
*C10L 1/18* (2006.01)

(52) U.S. Cl. ..... 585/14; 44/448; 44/449; 44/451; 123/1 A; 208/16

(58) Field of Classification Search ..... 44/300, 44/448, 449, 451; 123/1 A; 585/14; 208/16
See application file for complete search history.

(56) References Cited

U.S. PATENT DOCUMENTS 3,836,342 A * 9/1974 Shang et al. ..... 44/448

(Continued)

FOREIGN PATENT DOCUMENTS

CN 1295111 A 5/2001

(Continued)

OTHER PUBLICATIONS

"An Overview of Unocal's Low Emission Gasoline Research Program," P. J. Jessup, et al, SAE 920801, Feb. 24-28, 1992.

(Continued)

*Primary Examiner*—Cephia D Toomer
(74) *Attorney, Agent, or Firm*—Kelly L. Cummings; James R. Henes

(57) ABSTRACT

An unleaded reduced emissions gasoline having at least one of an octane less than about 86.7, a sulfur content less than about 40 ppmw sulfur and containing an oxygenate, and having reduced emissions by comparison to a minimum 87 octane gasoline. A method for reducing emissions from an automotive internal combustion engine is provided for a single vehicle and for a fleet. A method for reducing emissions by use of a distribution network is disclosed and a system for reducing emissions by a combination of a refinery and the vehicles is disclosed.

27 Claims, 6 Drawing Sheets

U.S. PATENT DOCUMENTS

| | | | | | |
|---|---|---|---|---|---|
| 4,541,836 | A | * | 9/1985 | Derderian | 44/452 |
| 4,812,146 | A | | 3/1989 | Jessup | |
| 5,288,393 | A | | 2/1994 | Jessup et al. | |
| H1305 | H | * | 5/1994 | Townsend et al. | 44/449 |
| 5,593,567 | A | | 1/1997 | Jessup et al. | |
| 5,653,866 | A | | 8/1997 | Jessup et al. | |
| 5,837,126 | A | | 11/1998 | Jessup et al. | |
| 6,007,589 | A | * | 12/1999 | Talbert | 44/300 |
| 6,030,521 | A | | 2/2000 | Jessup et al. | |
| 6,132,479 | A | | 10/2000 | Welstand et al. | |
| 6,241,791 | B1 | * | 6/2001 | Trotta et al. | 44/451 |
| 6,328,772 | B1 | * | 12/2001 | Scott et al. | 44/451 |
| 6,383,236 | B1 | * | 5/2002 | Welstand et al. | 44/300 |

FOREIGN PATENT DOCUMENTS

WO WO 01/21738 A1 3/2001

OTHER PUBLICATIONS

*Proceedings Division of Refining*, 1973, A volume of technical papers presented at the American Petroleum Institute Meeting, Philadelphia, Pa., May 14-17, 1973.

*The Interaction Approach To Gasoline Blending* by William. E. Morris, Petroleum Laboratory, E.I. du Pont de Nemours & Co., presented at the NPRA Annual Meeting, San Antonio, Texas, Mar. 23-25, 1975.

*Fluorine Compounds, Organic to Gold and Gold Compounds*, Encyclopedia of Chemical Technology, vol. 11, John Wiley & Sons, 1980.

*California Perspective on Controlling Gasoline Evaporative Emissions* by James Loop, Kevin Cleary and Bob Fletcher California Air Resources Board, Mar. 1986.

*Volatility Controls Face Opposition*, Chemical Week, Apr. 27, 1987.

*Ethers: A Key Ingredient For Reformulated Gasoline*, by Wm. J. Piel and R.X. Thomas, ARCO Chemical Company, National Conference on Octane Quality & Reformulated Fuels, San Antonio, Texas, Mar. 27-29, 1990.

Octane Week, vol. IV, No. 49, Apr. 30, 1990.

*Costs and Impacts of California Phase 2 Gasoline Regulations* by Robert F. Cunningham and Charles L. Miller, presented at the 1992 NPRA Annual Meeting, New Orleans, La., Mar. 22-24, 1992.

*Unocal Vows Not To Disrupt Cleaner Gas Debut*, Los Angeles Business Journal, Apr. 10-16, 1995.

*GM's Gasoline Specs Upset the Refiners*, Business Week.

*GM Still Wants Costly Light Gasoline*, The Oil and Gas Journal, Oct. 2, 1972.

*GM Bids For Radically New Gasoline*, The Oil and Gas Journal, Jan. 17, 1972.

*EPA Proposes to Stiffen Controls On Gasoline*, The Oil and Gas Journal, Jul. 27, 1987.

*Changes Keep HF Alkylation*, The Oil and Gas Journal, Feb. 11, 1974.

*Ethers Will Play Key Role In "Clean" Gasoline Blends*, The Oil and Gas Journal, Dec. 4, 1989.

Pages 44-47 showing charts of U.S. gasoline compositions, The Oil and Gas Journal, Apr. 9, 1990.

Proceedings American Petroleum Institute, 1959, Section III-Refining, Addresses and Reports, American Petroleum Institute.

*The Effect of Fuel Volatility Variations on Evaporative and Exhaust Emissions* by Exxon Research and Engineering Company, API Publication 4310, American Petroleum Institute, May 1979.

Manual on Significance of Tests for Petroleum Products, Sixth Edition, George V. Dyroff, Editor, American Society for Testing and Materials.

*Standard Specifications for Gasoline*, ASTM Designation: D439-70, American Society for Testing and Materials.

*Standard Specification for Automotive Spark-Ignition Engine Fuel*, Designation: D 4814-89, American Society for Testing and Materials.

*Carburetor Evaporation Losses* by J. T. Wentworth, General Motors Corp., Paper No. 128, Society of Automotive Engineers, Inc. Annual Meeting, Jan. 1958.

*Modern Refining for Today's Fuels and Lubricants* by Gerald K. Schmidt and Eugene J. Forster, Amoco Oil Co., Paper No. 841206 at the Society of Automotive Engineers, Inc. , Passenger Car Meeting, Society of Automotive Engineers, Inc., Dearborn, Michigan, 1984.

*The Properties and Performance of Modern Automotive Fuels* by P. Dorn and A. M. Mourao, Texaco Research Center, Paper No. 841210 at the Society of Automotive Engineers, Inc. , Passenger Car Meeting, Society of Automotive Engineers, Inc., Dearborn, Michigan, 1984.

*Engineering Know-How in Engine Design*—Part 19, Society of Automotive Engineers, Inc., Jun. 1971.

*Gasolines For Low-Emission Vehicles* by J. C. Ellis, 1973 SAE President, Sections Meetings, Society of Automotive Engineers, Inc., 1973.

*An Evaluation of the Performance and Emission of a CFR Engine Equipped with a Prechamber*, by D. B. Wimmer and R. C. Lee, Phillips Petroleum Co, Automobile Engineering Meeting, Detroit, Michigan, May 14-18, 1973, Society of Automotive Engineers, Inc., 1973.

*Road Octane Number Trends of Japanese Passenger Cars* by K. Date, T. Nishizaki and T. Maeda, Nippon Mining Co., Ltd., Paper No. 841210 at the Society of Automotive Engineers, Inc. , Passenger Car Meeting, , Society of Automotive Engineers, Inc., Detroit, Michigan, 1977.

*Fuel Blending and analysis for the Auto/Oil Air Quality Improvement Research Program* by R. H. Pahl, , Phillips Petroleum Co. and M. J. McNally, Mobil Research Development, 1990 SAE Technical Paper Series, International Fuels and Lubricants Meeting and Exposition, Tulsa, OK., Society of Automotive Engineers, Inc., Oct. 22-25, 1990.

*Use of Ethyl-t-Butyl Ether (ETBE) As A Gasoline Blending Component* by Clifford M. Shiblom, Gary A. Schoonveld, Richard K. Riley and Robert H. Pahl,, Phillips Petroleum Co., 1990 SAE Technical Paper Series, International Fuels and Lubricants Meeting and Exposition, Tulsa, OK., Society of Automotive Engineers, Inc., Oct. 22-25, 1990.

*1973 CRC Fuel Rating Program: Part 1: Road Octane Performance in 1973 Model Cars*, CRC Project No. CM-100-73, Coordinating Research Council, Inc., Feb. 1975.

*1975 CFC Fuel Rating Program: Road Octane Performance In 1975 Model Cars*, CRC Report No. 494, Coordinating Research Council, Inc., Oct. 1977.

*1978 CFC Fuel Rating Program: Road Octane Performance In 197 Model Cars*, CRC Report No. 510, Coordinating Research Council, Inc., Aug. 1979.

*Analysis of 1971 Road Rating Data: Unleaded Gasolines in 1971 Cars, Phase II: 1970-71 CRC Road Rating Program*, Coordinating Research Council, Inc., Jun. 1973.

*1973 CRC Fuel Rating Program , Part 1: Road Octane Performance in 1973 Model Cars*, Coordinating Research Council, Inc., Feb. 1975.

*Effect of Altitude Changes on Octane Number Requirement of Late Model Cars*, CRC Report No. 454, Coordinating Research Council, Inc., Oct. 1973.

*Air Pollution, EPA's Strategy to Control Emissions of Benzene and Gasoline Vapor*, GAO Report, Dec. 1985.

U.S. Court of Appeals, *Union Oil Co. of California* v. *Atlantic Richfield Co*., No. 99-1066, 54 USPQ 2d, 1227-1239.

California Air Resources Board; *Final Rejection Order—The California Reformulated Gasoline Phase 3 Amendments, Title 13, California Code of Regulation*; Aug. 3, 2000; p. 1-63; USA.

*Final Rejection Order—2004 Amendments Refining the California Phase 3 Reformulated Gasoline Regulations*; Mar. 9, 2005; p. 1-33; USA.

Coordinating Research Council, Inc. ; *CRC Report No. 477, 1973 CRC Fuel Rating Program—Part 1: Road Octane Performance in 1973 Model Cars*; Feb. 1975; p. 1-181; New York, NY; USA.

Coordinating Research Council, Inc.; *CRC Report No. 510—1978 Fuel Rating Program: Road Octane Performance in 1978 Model Cars*; Aug. 1979; p. 1, 2, 3, 17, 18; Alanta, GA; USA.

Coordinating Research Council, Inc.; *Analysis.of 1971 Road Rating Data: Unleaded Gasolines in 1971 Cars, Phase II: 1970-71 CRC Road Rating Program*; Jun. 1973; p. 1-156; New York, NY; USA.

*Final Report, 1996 American Petroleum Institute/National Petroleum Refiners Association Survey of Refining Operations and Product*

*Quality*; Jul. 1997;p. 2-3, Appendix A, G; National Petroleum Refiners Association;, American Petroleum Institute.

*Volume and Properties of Gasoline Produced by California Refinery, by Grade and Class; CEC Survey—Summer 1997*; 1998; P1; 1998 California Refinery Survey; USA.

*Regulation of Fuels and Fuel Additives—Modifications to Standards and Requirements for Reformulated and Conventional Gasoline, Proposed Rule*; Federal Register; Jul. 11, 1997; p. 37337-37338; vol. 62, No. 133.

*U.S. Petroleum Refining—Meeting Requirements for Cleaner Fuels and Refineries*, vol. I—*Analyses and Results*; Journal; Aug. 1993; p. 13, 16,215, 217-219, 222; National Petroleum Council.

*Reformulated Fuel Regulations Costly*, Journal; Jan. 17, 1994; p. 15; Oil & Gas Journal.

*Alcohols and Ether—A Technical Assessment of Their Application as Fuels and Fuel Components*; Journal; Jul. 1988; p. 4-6, 23, 41;API Publication 4261, Second Edition.

* cited by examiner

METHOD AND AN UNLEADED LOW EMISSION GASOLINE FOR FUELING AN AUTOMOTIVE ENGINE WITH REDUCED EMISSIONS

RELATED APPLICATIONS

This invention is entitled to and hereby claims the benefit of the filing date of U.S. provisional application No. 60/288,054 entitled "METHOD FOR FUELING AN AUTOMOTIVE ENGINE WITH REDUCED TOTAL EMISSIONS FROM A MODIFIED REFINING PROCESS IN COMBINATION WITH A GASOLINE SUITABLE FOR USE IN AN AUTOMOTIVE ENGINE" filed: May 2, 2001 and U.S. provisional application No. 60/288,142 entitled "METHOD FOR FUELING AN AUTOMOTIVE ENGINE WITH REDUCED TOTAL EMISSION FROM A MODIFIED REFINING PROCESS IN COMBINATION WITH A GASOLINE SUITABLE FOR USE IN AN AUTOMOTIVE ENGINE" filed: May 2, 2001.

FIELD OF THE INVENTION

This invention relates to a method for reducing the emissions of total hydrocarbons, carbon monoxide, and nitrogen oxides from an internal combustion automotive engine upon combustion of gasoline therein to power the engine. In some embodiments the invention also relates to an unleaded reduced emissions gasoline having at least one of an octane less than 86.7, a sulfur content less than about 40 ppmw and an oxygenate content selected to provide a selected amount of oxygen in the fuel. In other embodiments the invention also relates to a combined process wherein a refinery is operated with reduced emissions to produce the unleaded low emission gasoline for use in fueling automotive vehicles and to a distribution system for the unleaded low emissions gasoline.

BACKGROUND OF THE INVENTION

In recent years, there has been increasing concern over the availability of worldwide supplies of crude oil and other fluid hydrocarbon feedstocks and fuels. There have similarly been concerns about the emission of undesirable materials into the atmosphere upon combustion of fuels, such as gasoline, in internal combustion engines. These concerns have led to attempts to require the use of reformulated gasolines in areas of acute air pollution such as California. California has enacted requirements for a Phase 2 California reformulated gasoline for gasoline used in California. (Title 13 C.C.R, Sections 2250-2273 (including test method amendments effective Sep. 27, 2001)). These fuel specifications are referred to herein as "California formulated gasoline specifications." The requirements of ASTM D4814-01a (Approved Nov. 10, 2001), hereby incorporated by reference, are widely applicable, to gasolines produced in the United States, but various countries, states and local governmental entities may apply other or additional requirements. This concern for cleaner burning gasolines has resulted in requirements for gasolines that require more refining to produce the desired properties in the gasoline. Typically, the gasolines produced today have an octane requirement of a minimum octane of 87 for regular gasoline or a 92 minimum octane for premium gasoline. The octane values referred to are a combination of the research motor octane number plus the motor octane number divided by two, i.e. (R+M)/2. These fuels typically require the production in a refining operation of high-octane blending components. Typically, such high-octane blending components are produced in alkylation and reforming units. In some instances addition of dimers of isobutene or isobutene with n-butene may be used to increase octane. The reformate is more highly aromatic than the fuels produced by alkylation or dimerization of butenes. These materials alone or in combination are typically used as octane enhancers in gasoline blends. Operation of octane enhancing units, such as alkylation units and reformers, is relatively energy intensive and requires substantial quantities of natural gas or other energy sources. As a result of the processing, some of the feedstocks are lost to unusable products. As a result of this requirement for higher octane blending components coupled with the requirement for specific compositional requirements in the reformulated gasoline, more crude oil or other gasoline component feedstocks are required to produce a given quantity of gasoline than was previously the case.

In the production of reformulated gasoline, added refining steps are necessary to produce the desired amount of high octane blending components while removing undesirable compounds and modifying the properties of other fuel blending streams (such as by isomerization of $C_5$ range paraffins and the like) to meet the rather stringent distillation and other requirements of reformulated gasoline. The net result has been an increase in the refining expense and in the amount of crude oil required to produce the reformulated gasoline by comparison to gasoline meeting the requirements of ASTM D4814-01a. While the use of reformulated gasoline is considered to have been an improvement in reducing emissions from automotive engines fueled with reformulated gasoline, the emission of pollutants to the atmosphere from engines fueled with reformulated gasoline must be considered in combination with the increased emissions to the atmosphere from the refineries producing such fuels, especially carbon dioxide, which has been the subject of attention recently with respect to possible greenhouse effects.

SUMMARY OF THE INVENTION

In a first embodiment, this invention relates to an unleaded low emissions gasoline for use in internal combustion engines having an octane (R+M)/2 less than 86.7 and a sulfur content less than about 10 ppmw.

In a further embodiment, this invention also relates to an unleaded low emissions gasoline for use in an internal combustion automotive engine and having an octane (R+M)/2 less than 86.7, which upon combustion in the automotive engine produces emissions of at least one of total hydrocarbons, carbon monoxide and nitrogen oxides by comparison to a comparable unleaded minimum 87 octane gasoline for use in the automotive engine no greater than from the unleaded minimum 87 octane gasoline.

In another embodiment, this invention further relates to an unleaded reduced emissions gasoline for use in an internal combustion automotive engine containing a selected quantity of an oxygenate selected from the group consisting of ethanol, methyl tertiary butyl ether, ethyl tertiary butyl ether and tertiary amyl methyl ether and having an octane (R+M)/2 less than 86.7, the unleaded reduced emissions gasoline upon combustion in the automotive engine producing reduced emissions of at least one of total hydrocarbons, carbon monoxide and nitrogen oxides by comparison to combustion of a comparable unleaded minimum 87 octane gasoline in the engine.

A fourth embodiment of this invention further relates to an unleaded reduced emissions gasoline for use in an internal combustion automotive engine, having an octane less than 86.7 and having a sulfur content less than about 40 ppmw, which upon combustion in the engine produces reduced emissions of at least two of total hydrocarbons, carbon monoxide and nitrogen oxides by comparison to combustion of a comparable unleaded minimum 87 octane gasoline in the engine.

Another embodiment of this invention relates to a method for reducing emissions of at least one of total hydrocarbons, carbon monoxide and nitrogen oxides from an internal combustion automotive engine, the method comprising:

a) producing an unleaded reduced emissions gasoline having an octane (R+M)/2 less than 86.7 which upon combustion in the engine produces reduced emissions of at least one of total hydrocarbons, carbon monoxide and nitrogen oxides by comparison to a comparable unleaded minimum 87 octane gasoline; and, b) fueling the engine with the unleaded reduced emissions gasoline.

In a further embodiment, the invention relates to a method for reducing emissions of at least one of total hydrocarbons, carbon monoxide and nitrogen oxides from a fleet of vehicles powered by internal combustion automotive engines the method comprising:

a) producing an unleaded reduced emissions gasoline having an octane (R+M)/2 less than 86.7 which upon combustion in the engines produces reduced emissions of at least one of total hydrocarbons, carbon monoxide and nitrogen oxides by comparison to a comparable unleaded minimum 87 octane gasoline; and, b) fueling the fleet of vehicles with the unleaded reduced emissions gasoline.

An embodiment of the invention relates to a method for fueling automotive vehicles with reduced total emissions to the atmosphere the method comprising:

a) operating a refinery to produce an unleaded reduced emissions gasoline having an octane (R+M)/2 less than 86.7 which upon combustion in an engine produces reduced emissions of at least one of total hydrocarbons, carbon monoxide and nitrogen oxides by comparison to a comparable unleaded minimum 87 octane gasoline, the unleaded reduced emissions gasoline being produced in the refinery from a reduced quantity of feedstock and with reduced emissions by comparison to a refinery operated to produce the minimum 87 octane gasoline; and, b) fueling automotive vehicles with the unleaded reduced emissions gasoline, the total emissions of at least one of total hydrocarbons, carbon monoxide, carbon dioxide and nitrogen oxides for the vehicles and for the refinery producing the reduced emissions gasoline being less than for a refinery producing the unleaded minimum 87 octane gasoline and for the vehicles fueled with minimum 87 octane unleaded gasoline.

DESCRIPTION OF PREFERRED EMBODIMENTS

Gasolines are well known fuels, as disclosed in U.S. Pat. No. 5,288,393 issued Feb. 22, 1994 to Jessup et al, generally composed of a mixture of hydrocarbons boiling at atmospheric pressure in a very narrow temperature range, e.g., 77° F. (25° C.) to 437° F. (225° C.). Gasolines are typically composed of mixtures of aromatics, olefins, and paraffins, although some gasolines may also contain such added non-hydrocarbons as alcohol (e.g., ethanol) or other oxygenates (e.g., methyl tertiary butyl ether). Gasolines may also contain various additives, such as detergents, anti-icing agents, demulsifiers, corrosion inhibitors, dyes, deposit modifiers, as well as octane enhancers such as tetraethyl lead. Typically unleaded gasolines contain a concentration of lead no greater than 0.05 gram of lead per gallon (0.013 gram of lead per liter). The unleaded gasoline will typically have an octane value (R+M)/2 for regular gasoline of at least 87 and for premium of at least 92. For purposes of this invention "gasolines" are considered to be fuels widely commercially available to consumers and do not include materials prepared for further processing or blending prior to sale to consumers.

Such gasolines are typically used to fuel internal combustion engines, used to propel automotive vehicles and for other purposes to which such engines are known to be suited. Such gasolines may also be used in other types of internal combustion engines such as homogeneous charge compression engines wherein the fuel and air are injected as a homogeneous mixture prior to compression and the like.

Presently most gasoline sold in the United States for use in automotive engines has an octane (R+M)/2 of at least 87 for regular and of at least 92 for premium. These octane levels are considered necessary to prevent knocking and auto ignition in automotive engines. As well-known to the art, octane levels are typically adjusted or adjustable in response to climatic conditions and reduced atmospheric pressure. For instance, a 4.5 octane number reduction results in an equivalent octane for use in the highest regions of the mountainous western portion of the United States. The octanes referred to herein are measured at substantially sea level (approximately 300 feet above sea level) and must be adjusted appropriately for higher altitudes.

Figure 5:
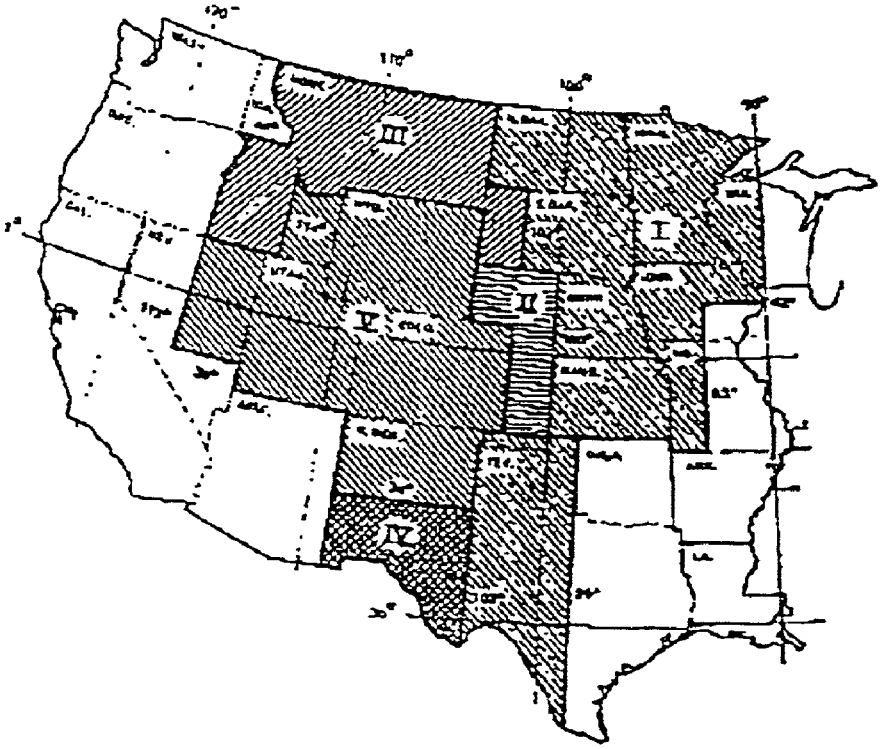
FIG. 5 shows the regional adjustment areas for altitude octane adjustment.

As shown in table A the octane is reduced for higher altitude regions (lower atmospheric pressure) of the United States as shown in FIG. 5.

TABLE A

| Area | less than 89 AKI |
|---|---|
| I | 0.7 |
| II | 1.5 |
| III | 2.2 |
| IV | 3.0 |
| V | 4.5 |

Similar adjustments are required in other high altitude regions of the world. Adjustments of up to 1.0 octane number reductions may also be made in certain regions of the United States for climatic conditions or other countries with similar climatic conditions.

TABLE B

| | J | F | M | A | M | J | J | A | S | O | N | O |
|---|---|---|---|---|---|---|---|---|---|---|---|---|
| NORTHEAST | 1.0 | 0.5 | 0.5 | 0 | 0 | 0 | 0 | 0 | 0 | 0.5 | 0.5 | 1.0 |
| SOUTHEAST | 0.5 | 0 | 0 | 0 | 0 | 0.5 | 0.5 | 0.5 | 0.5 | 0 | 0 | 0.5 |
| MIDWEST | 1.0 | 0.5 | 0.5 | 0 | 0 | 0 | 0 | 0 | 0 | 0 | 0.5 | 1.0 |
| NORTHWEST | 1.0 | 1.0 | 0.5 | 0.5 | 0 | 0 | 0 | 0 | 0 | 0.5 | 1.0 | 1.0 |
| SOUTHWEST | 1.0 | 0.5 | 0 | 0 | 0 | 0 | 0 | 0 | 0 | 0 | 0.5 | 1.0 |
| CALIFORNIA | | | | | | | | | | | | |
| NO COAST | 0.5 | 0.5 | 0.5 | 0.5 | 0.5 | 0.5 | 0.5 | 0.5 | 0 | 0 | 0.5 | 0.5 |
| SO COAST | 0 | 0 | 0.5 | 0.5 | 1.0 | 1.0 | 1.0 | 0.5 | 0.5 | 0 | 0 | 0 |
| ALASKA | 1.0 | 1.0 | 0.5 | 0.5 | 0 | 0 | 0 | 0 | 0 | 0.5 | 1.0 | 1.0 |
| HAWAII | 0 | 0 | 0 | 0 | 0 | 0 | 0 | 0 | 0 | 0 | 0 | 0 |

Figure 6:
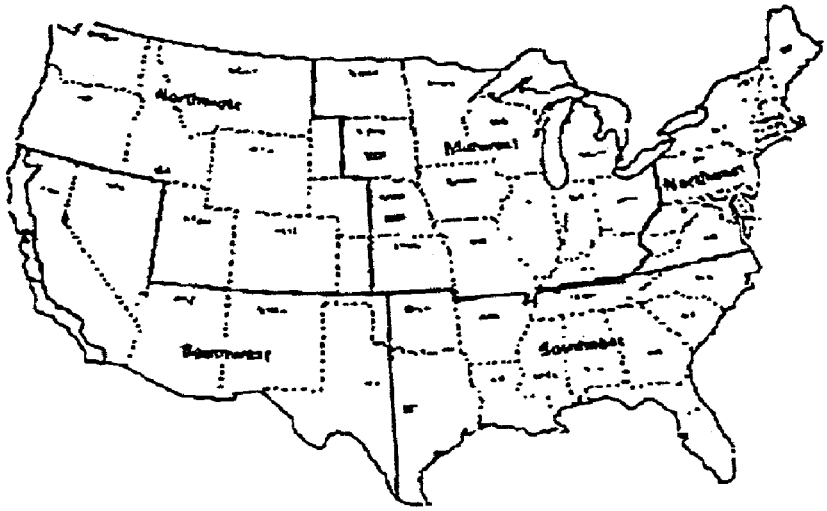
FIG. 6 shows the regional adjustments and seasonal adjustments for octane.

Both tables A and B and FIGS. 5 and 6 are shown in ASTM 4814-01a. The present invention is based upon a reduction of the octane of the gasoline marketed in the higher altitude regions by from 1 to 7 octane numbers and preferably from 2 to 5 octane numbers from that commercially available. Accordingly the octane values discussed herein may be adjusted for the region in which the gasoline is marketed, and where the octane is so adjusted, the octane is referred to as an "adjusted octane number." For example in Denver an 86.7 octane number would be 82.2 or if also corrected for climatic conditions would be 81.2.

Presently gasolines are required to meet various Specifications such as those in ASTM D4814-01a, the California reformulated gasoline specifications and other applicable Federal, state and local specifications.

These specifications and octane requirements as indicated previously require the substantial modification of gasoline blending streams available in most refineries. In particular, to meet the California reformulated gasoline specifications, it is frequently necessary to adjust the olefin content of the gasoline, to adjust the paraffin content of the gasoline, the aromatics content of the gasoline and the like. It is further necessary to adjust the octane to meet minimum octane requirements. It is also frequently necessary to modify other properties, including T10, T50, T90, Reed Vapor Pressure, as known to those skilled in the art and as required to meet regulatory requirements.

According to the present invention it has been found that, surprisingly reduced emissions are achieved with an unleaded reduced emissions gasoline for use in an internal combustion automotive engine and having an octane (R+M)/2 less than 86.7 which upon combustion in the internal combustion automotive engine, produces emissions of at least one of total hydrocarbons, carbon monoxide and nitrogen oxides which are less by comparison to a comparable unleaded minimum 87 octane gasoline for use in an internal combustion automotive engine. The unleaded minimum 87 octane gasoline and the unleaded reduced emissions gasoline are desirably both in compliance with the California reformulated gasoline specifications or ASTM D4814-01a. Of course, the comparison may be made wherein the unleaded reduced emissions gasoline is in compliance with either or both of these specifications and where the unleaded minimum 87 octane gasoline may or may not be in full compliance with either or both. In many instances it has been found that at least two of total hydrocarbons, carbon monoxide and nitrogen oxides emissions, and in some instances all three, are equal to or less than for a comparable 87+ octane unleaded gasoline.

Reference to a "comparable fuel" refers to a fuel that has similar properties to the unleaded reduced emissions gasoline. It is considered that the reduced emissions realized by the present invention may be realized with many gasoline formulations but for comparison the reduced emissions achieved using the unleaded reduced emissions gasoline are most easily determined by comparison to a gasoline of the same or a similar composition wherein only the indicated ones of octane, sulfur content and oxygenate content are varied from the comparative fuel in accordance with the present invention. It is recognized that some compositional changes in the comparative gasoline may be necessary to change the indicated properties but the compositional change will be minimal. For example, such changes may be implemented by a refinery blending program in response to a request for lower octane gasoline, etc. As previously noted, it is believed that the reduction in emissions is achieved with gasolines generally but determination of the amount of the improvement by the comparison is desirably made as discussed above.

Typically, emissions from combustion of the unleaded reduced emissions gasoline are lower in total hydrocarbons and carbon monoxide than the emissions from the combustion of the unleaded minimum 87 octane gasoline. Desirably, the octane of the unleaded reduced emissions gasoline is from about 80 to 86.7. The octane may be about 86 or lower. Reductions have been shown with octanes of about 85 and about 84. It is considered that octanes lower than about 83, 82 and 81 down to about 80 are also suitable.

The unleaded reduced emissions gasoline may contain one or more oxygenates commonly used for the introduction of oxygen into gasolines. Suitable oxygenates are ethanol, methyl tertiary butyl ether, ethyl tertiary butyl ether, tertiary amyl methyl ether, combinations thereof and the like. Desirably, the oxygenate is present in an amount selected to provide a selected amount of oxygen in the fuel. Typically, amounts sufficient to provide oxygen in the gasoline in an amount from about 0.1 to about 10 weight percent are used. Preferably the amount is from about 0.3 to about 5.0 weight percent and desirably from about 2 to about 5 weight percent. Of the oxygenates, ethanol and methyl tertiary butyl ether are preferred and of these ethanol is most preferred. When ethanol is used, it is typically added in amounts equal to from about 0.1 to about 10 vol. % of the gasoline. These amounts could vary dependent upon future gasoline specifications and the like.

By reducing the octane of the gasoline as discussed above, it is considered that the emission of carbon monoxide is reduced. The full range of reduced octane values may be used with the gasoline with or without the oxygenates.

It is further desirable that the unleaded reduced emissions gasoline contains less than about 40 ppmw (parts per million by weight) of sulfur. Preferably, the sulfur is present in an amount less than about 30 ppmw, desirably, less than about 15 ppmw and more desirably, less than about 10 ppmw, and most desirably, less than about 5 ppmw.

The unleaded reduced emissions gasoline may be produced with an octane in the range described and containing an oxygenate in a selected amount and with the low sulfur content. Either the oxygenates or the low sulfur content alone may be used in combination with the low octane values to achieve desirable results. Many of the gasolines of the present invention are within the specifications for California reformulated gasoline as well as in compliance with all ASTM D4814-01a and other federal, state, and local gasoline specifications. Specifically ethanol contents of the gasoline may be required to be up to 10 vol. % or higher.

While the use of the unleaded reduced emissions gasoline of the present invention in a single vehicle is effective to reduce emissions from the single vehicle it is more effective when the gasoline is used to fuel a fleet of vehicles. By this approach the emissions may be reduced from a large number of vehicles as well as from a single vehicle. A fleet of vehicles is used to refer to any substantial number of vehicles (i.e., 100 or more vehicles) that may be operated using the unleaded reduced emissions gasoline of the present invention. The terms "fuel or "fueling" as used herein refer to providing the unleaded low emissions gasoline to automotive vehicles and combustion of the fuel therein to power the vehicles.

Further, it may be desired to reduce the pollution in an area and the emissions may be reduced in the area by distributing the unleaded reduced emissions gasoline via a plurality of distribution networks to distribution outlets from which it may be distributed to a fleet of selected vehicles or to randomly service automotive vehicle customers. In such instances the emissions from automotive vehicles in the area can be reduced.

It is further contemplated as a part of the present invention that emissions from the operation of automotive vehicles may be further reduced. The emissions resulting from fueling automotive vehicles results from the emissions from the vehicle itself and also from the emissions from the refinery in which the gasoline to fuel the automotive vehicle is produced. According to the present invention the refinery may be operated to produce more gasoline per a given volume of gasoline feedstock as a result of the lower octane requirements of the gasoline. Such refinery operation may involve changes in the operation of at least one of a fluid catalytic cracker, a reformer, an alkylation unit, an isomerization unit, and the like, as known to those skilled in the art. As a further result of the operation of the refinery in this manner the refinery requires less fuel for heat and other operations to produce the reduced quantity of higher-octane blending components. Typically, the greater the reduction in octane the greater the improvement in the volume of gasoline generated from a given volume of feedstock and the greater the reduction in the emissions from the refinery. Typically, the refinery emissions are primarily carbon dioxide and in recent years considerable attention has been directed to methods for reducing the emission of carbon dioxide.

In one computer simulation of a refinery operation, assuming a gasoline pool of 800,000 barrels per day of 87 octane gasoline as a base case, the alteration of the refinery operation to produce gasoline having an octane of 86 results in production of an additional 35,280 gallons of gasoline per day from the same quantity of the same feedstock with a concurrent reduction of more than 17,000,000 pounds per year of carbon dioxide emitted from the refinery and a reduction of over 6,000,000 pounds per year of natural gas required for fuel. The net result is a substantial savings in the refinery requirements for light hydrocarbons or other fuel and a substantial reduction in the amount of carbon dioxide emitted into the atmosphere. Since the refinery operates at reduced emissions into the atmosphere and produces the gasoline of the present invention from a reduced quantity of feedstock considerable efficiency and emissions reduction is accomplished. Also, a substantial reduction of the total emissions into the atmosphere as a result of the production and use of the lower octane gasoline for automotive engines is realized. Even if the use of the lower octane gasoline in an automotive engine resulted in the same amount of emissions as with the 87 and higher octane fuels there would still be a net reduction of the emissions to the atmosphere as a result of the increased efficiency of and reduced emissions from the refinery operation.

EXAMPLES

Tests were performed to determine exhaust emissions from a three-vehicle fleet using lower (less than 86.7) octane gasolines by comparison to 87 minimum octane gasolines. The gasolines tested are shown in Table 1. These gasolines were prepared from refinery streams or components considered equivalent to the substituted refinery streams. The refinery streams used were an isomerate stream, a heavy reformate and catalytically cracked naphtha, a heavy raffinate, and a light alkylate, with toluene being used as a substitute for light reformate and mixed iso-hexanes as a substitute for light raffinate. Light reformate is typically considered to be primarily a $C_7$-$C_8$ stream which is predominantly toluene, thus toluene is representative of this stream. Similarly the mixed iso-hexanes are considered to be a close substitute for the light raffinate. It is also noted that the olefin levels in the fuels tested were low. This was a result of the difficulty in finding suitable low sulfur blending stocks that were low in sulfur with higher olefin contents. The low olefins content is not considered to have any disparate effect on the validity of the test results. In any event a wide variety of blending components can be used to produce gasoline. The gasolines tested have been designed to be closely comparable except for the octane, sulfur content and oxygenate content. Ethanol was the oxygenate fuel tested and was supplied as a commercial fuel grade material. The fuel properties were targeted to meet the California reformulated gasoline specifications, except for fuel 4 as noted below. The term "fuel" is used synonymously with the term "gasoline" herein. Fuels 1 and 6 have a standard octane of 87+. Fuel 1 has a relatively high sulfur content (70 ppmw) and an 87.4 octane with fuel 6 having a low sulfur content, (<5) with an 87.2 octane. The sulfur level of the low octane fuels 2-5 was reduced to less than 5 ppmw to anticipate further low sulfur regulations. Fuel 4 has an octane value of 83.12 but also has a 90° F distillation temperature of 338°, which exceeds the California reformulated gasoline specifications but would meet the requirements in other areas. Fuel 5 was blended with enough ethanol to give 2 weight percent oxygen in the fuel. Two more fuels 7 and 8 were prepared and tested using varying sulfur content with octanes of 85.8 and 85.3 respectively and higher sulfur levels of 37 and 72 ppmw, respectively.

TABLE 1

FUEL PROPERTIES

| Fuel | 1 | 2 | 3 | 4 | 5 | 6 | 7 | 8 |
|---|---|---|---|---|---|---|---|---|
| Anti-knock Index, (R + M)/2 | 87.4 | 80.3 | 84.9 | 83.2 | 81.4 | 87.2 | 85.8 | 85.3 |
| Sulfur (ppmw) (ASTM D 5453) | 70 | <5 | <5 | <5 | <5 | <5 | 37 | 72 |
| Research Octane Number (ASTM D 2699) | 90.5 | 82.5 | 87.2 | 85.5 | 83.5 | 89.6 | 88.4 | 87.9 |
| Motor Octane Number (ASTM D 2700) | 84.2 | 78.1 | 82.5 | 80.8 | 79.2 | 84.7 | 83.1 | 82.6 |

TABLE 1-continued

| FUEL PROPERTIES | | | | | | | | |
|---|---|---|---|---|---|---|---|---|
| Fuel | 1 | 2 | 3 | 4 | 5 | 6 | 7 | 8 |
| Reid Vapor Pressure (psi) (ASTM D 5191) | 6.7 | 6.7 | 6.5 | 6.4 | 6.8 | 6.1 | 6.6 | 6.4 |
| 10% Distillation Temp. (° F.) (ASTMD 86) | 142 | 140 | 142 | 140 | 135 | 148 | 141 | 142 |
| 50% Distillation Temp. (° F.) (ASTMD 86) | 202 | 199 | 209 | 212 | 196 | 201 | 204 | 205 |
| 90% Distillation Temp. (° F.) (ASTM D 86) | 298 | 292 | 295 | 338 | 291 | 281 | 291 | 296 |
| API Gravity (°API) (ASTMD 4052) | 61.5 | 62.6 | 62.2 | 62.3 | 61.5 | 62.9 | 61.6 | 61.2 |
| Aromatics (Vol. %) (ASTM D 1319) | 25 | 25 | 25.5 | 22 | 25 | 22.3 | 24.7 | 25.2 |
| Olefins (Vol %) (ASTM D 1319) | 1.5 | 0 | 0 | 1.5 | 0 | 0 | 0.6 | 0.7 |
| Saturates (Vol %) (ASTM D 1319) | 73.5 | 75 | 74.5 | 76.5 | 74.6 | 77.7 | 74.7 | 74.1 |
| Benzene (Vol. %) (ASTM D 5580) | 0.17 | <0.1 | <0.1 | <0.1 | <0.1 | <0.1 | <0.1 | 0.16 |
| Ethanol (Vol. %) (measured addition) | 0.0 | 0.0 | 0.0 | 0.0 | 5.6 | 0.0 | 0.0 | 0.0 |

Duplicate emission tests on each fuel were conducted using the Federal test procedure (FTP) on the first six fuels in three vehicles. The FTP (Federal Test Procedure) specified herein refers to Code of Federal Regulations, Volume 40, "Protection of the Environment," Subpart B, "Emission Regulations for 1977 and Later Model Year New Light-duty Vehicles and New Light-Duty Trucks; Test Procedures, herein incorporated by reference in its entirety. The test vehicles were a 1998 Honda Accord with California low emission vehicle (LEV) certification, a 1999 Dodge Caravan with national low emissions vehicle (NLEV) certification, and a 2000 Ford Explorer. Table 2 shows the emission test results for total hydrocarbons, carbon monoxide, and nitrogen oxides from the tests with the various fuels.

TABLE 2

| Vehicle Emissions Data | | | | | | |
|---|---|---|---|---|---|---|
| | | | EMISSIONS* | | | |
| Vehicle | Odometer | Fuel | THC | CO | NOx | Test Date |
| Ford Explorer | 44991 | 1 | 0.080 | 1.207 | 0.036 | Mar. 8, 2002 |
| Ford Explorer | 45002 | 1 | 0.089 | 1.075 | 0.039 | Mar. 9, 2002 |
| Ford Explorer | 45020 | 2 | 0.088 | 0.962 | 0.038 | Mar. 10, 2002 |
| Ford Explorer | 45030 | 2 | 0.076 | 0.874 | 0.037 | Mar. 11, 2002 |
| Ford Explorer | 44929 | 3 | 0.084 | 1.099 | 0.030 | Mar. 4, 2002 |
| Ford Explorer | 44939 | 3 | 0.077 | 1.005 | 0.029 | Mar. 5, 2002 |
| Ford Explorer | 44961 | 4 | 0.088 | 0.872 | 0.031 | Mar. 6, 2002 |
| Ford Explorer | 44971 | 4 | 0.090 | 0.882 | 0.028 | Mar. 7, 2002 |
| Ford Explorer | 45051 | 5 | 0.088 | 1.042 | 0.036 | Mar. 20, 2002 |
| Ford Explorer | 45061 | 5 | 0.080 | 1.086 | 0.038 | Mar. 21, 2002 |
| Ford Explorer | 45184 | 6 | 0.085 | 1.166 | 0.023 | Apr. 2, 2002 |
| Ford Explorer | 45195 | 6 | 0.091 | 0.959 | 0.023 | Apr. 3, 2002 |
| Honda Accord | 84530 | 1 | 0.097 | 2.177 | 0.126 | Mar. 10, 2002 |
| Honda Accord | 84540 | 1 | 0.101 | 2.197 | 0.119 | Mar. 11, 2002 |
| Honda Accord | 84561 | 2 | 0.071 | 1.693 | 0.082 | Mar. 12, 2002 |
| Honda Accord | 84572 | 2 | 0.077 | 1.653 | 0.079 | Mar. 13, 2002 |
| Honda Accord | 84448 | 3 | 0.086 | 2.305 | 0.101 | Mar. 5, 2002 |
| Honda Accord | 84459 | 3 | 0.083 | 2.095 | 0.090 | Mar. 6, 2002 |
| Honda Accord | 84472 | 4 | 0.089 | 1.467 | 0.090 | Mar. 7, 2002 |
| Honda Accord | 84483 | 4 | 0.086 | 1.555 | 0.087 | Mar. 8, 2002 |
| Honda Accord | 84591 | 5 | 0.070 | 1.390 | 0.108 | Mar. 20, 2002 |
| Honda Accord | 84601 | 5 | 0.065 | 1.289 | 0.106 | Mar. 21, 2002 |
| Honda Accord | 84649 | 6 | 0.079 | 2.122 | 0.067 | Apr. 2, 2002 |
| Honda Accord | 84661 | 6 | 0.079 | 1.969 | 0.070 | Apr. 3, 2002 |
| Honda Accord | 84620 | 7 | 0.088 | 2.186 | 0.076 | Mar. 29, 2002 |

TABLE 2-continued

| Vehicle Emissions Data | | | | | | |
|---|---|---|---|---|---|---|
| | | | EMISSIONS* | | | |
| Vehicle | Odometer | Fuel | THC | CO | NOx | Test Date |
| Honda Accord | 84631 | 7 | 0.093 | 2.118 | 0.073 | Apr. 1, 2002 |
| Honda Accord | 84690 | 8 | 0.081 | 1.830 | 0.099 | Apr. 17, 2002 |
| Honda Accord | 84701 | 8 | 0.076 | 1.715 | 0.100 | Apr. 18, 2002 |
| Dodge Caravan | 65053 | 1 | 0.104 | 0.585 | 0.163 | Mar. 8, 2002 |
| Dodge Caravan | 65064 | 1 | 0.105 | 0.546 | 0.145 | Mar. 9, 2002 |
| Dodge Caravan | 65084 | 2 | 0.110 | 0.814 | 0.147 | Mar. 10, 2002 |
| Dodge Caravan | 65095 | 2 | 0.100 | 0.789 | 0.156 | Mar. 11, 2002 |
| Dodge Caravan | 64990 | 3 | 0.089 | 0.633 | 0.134 | Mar. 4, 2002 |
| Dodge Caravan | 65001 | 3 | 0.086 | 0.649 | 0.156 | Mar. 5, 2002 |
| Dodge Caravan | 65022 | 4 | 0.090 | 0.396 | 0.106 | Mar. 6, 2002 |
| Dodge Caravan | 65032 | 4 | 0.088 | 0.419 | 0.120 | Mar. 7, 2002 |
| Dodge Caravan | 65121 | 5 | 0.092 | 0.515 | 0.135 | Mar. 20, 2002 |
| Dodge Caravan | 65131 | 5 | 0.088 | 0.541 | 0.125 | Mar. 21, 2002 |
| Dodge Caravan | 65150 | 6 | 0.087 | 0.669 | 0.108 | Apr. 2, 2002 |
| Dodge Caravan | 65161 | 6 | 0.093 | 0.683 | 0.113 | Apr. 3, 2002 |

*ALL EMISSIONS ARE SHOWN IN GRAMS PER MILE.

Figure 1:
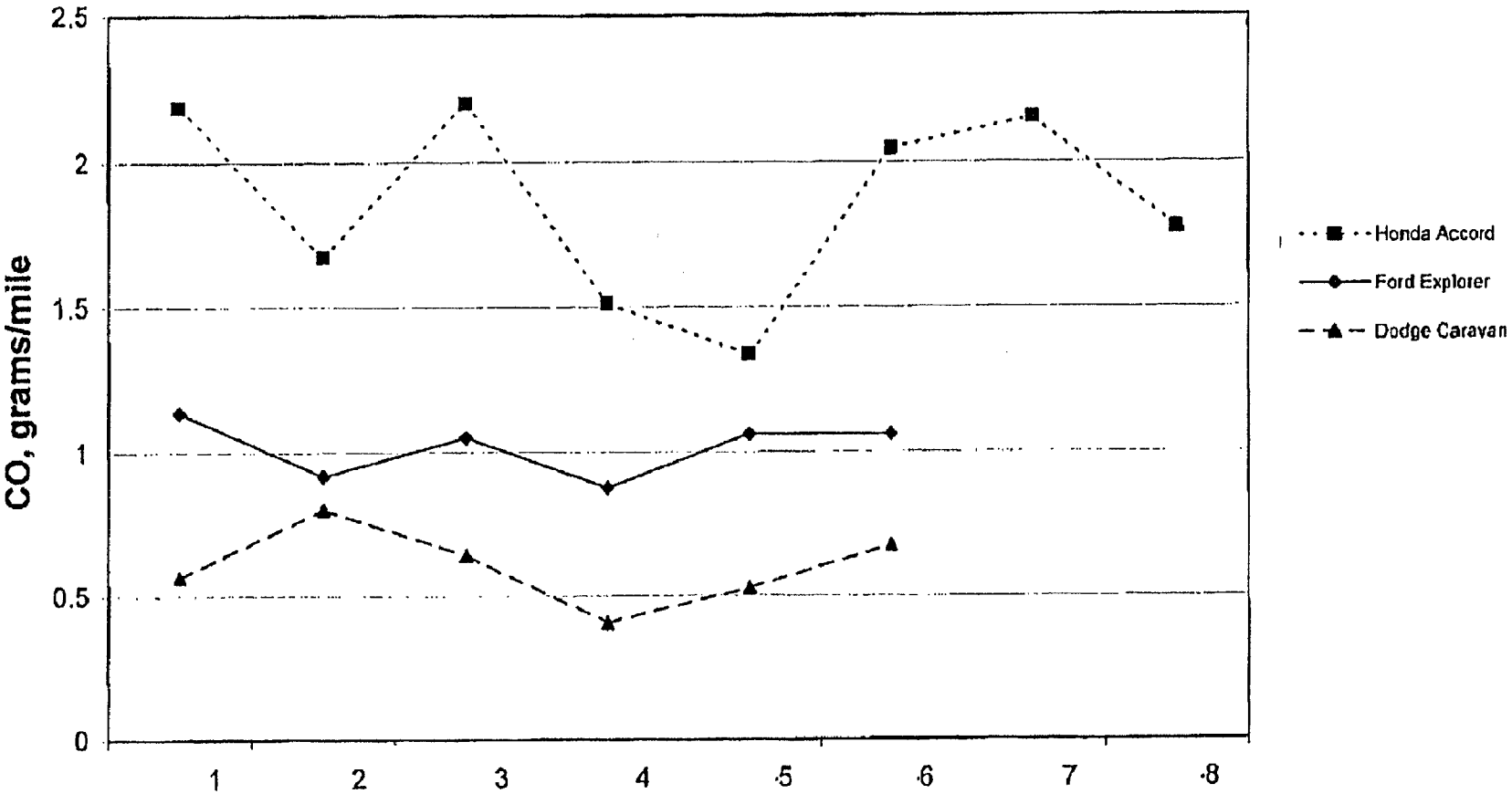
FIG. 1 is a graph showing the carbon monoxide emissions from the vehicles and the fuels tested.
Figure 2:
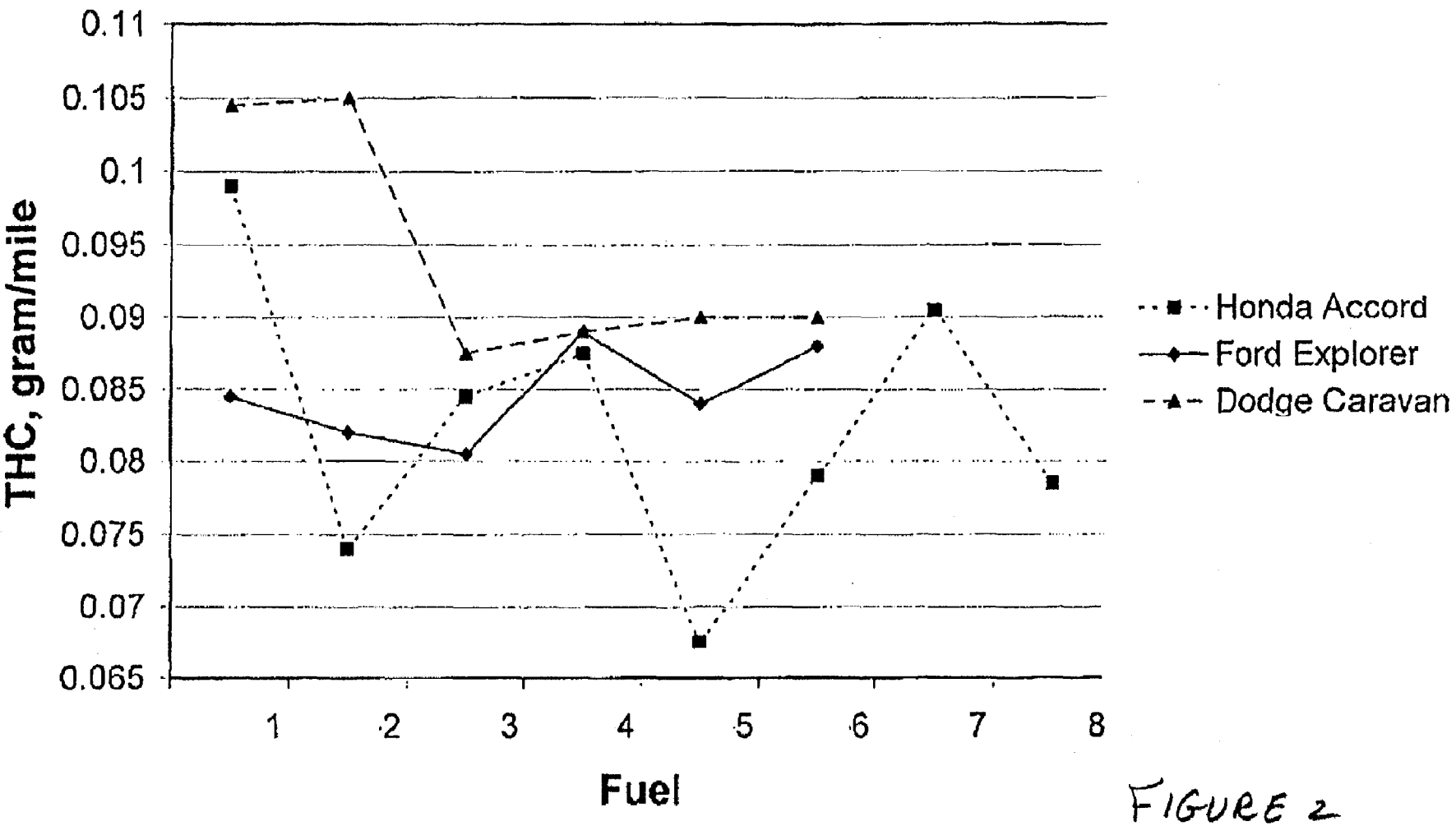
FIG. 2 is a graph showing the total hydrocarbon emissions from the vehicles and the fuels tested.
Figure 3:
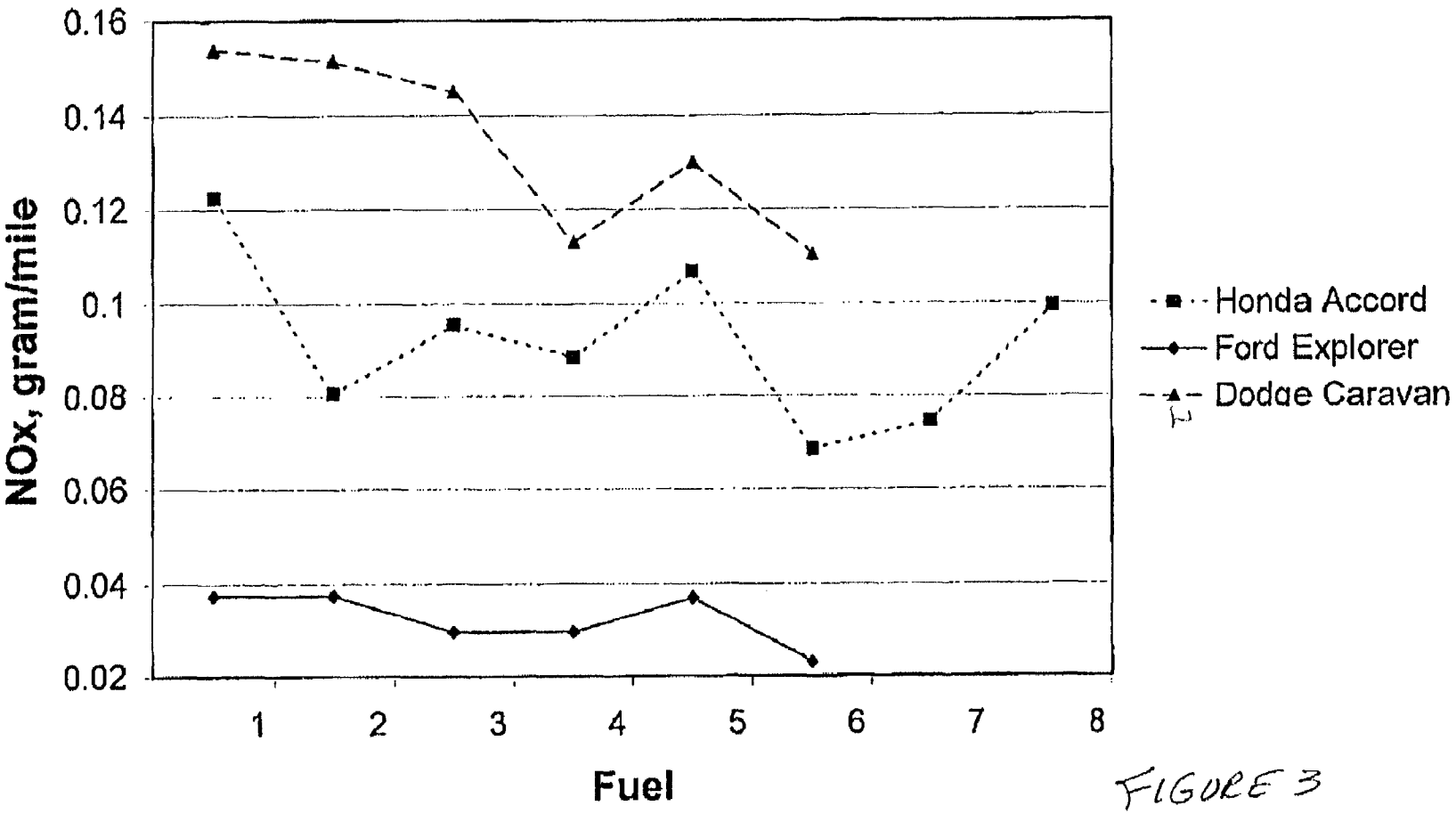
FIG. 3 shows the nitrogen oxide emissions from the vehicles and the fuels tested.
Figure 4:
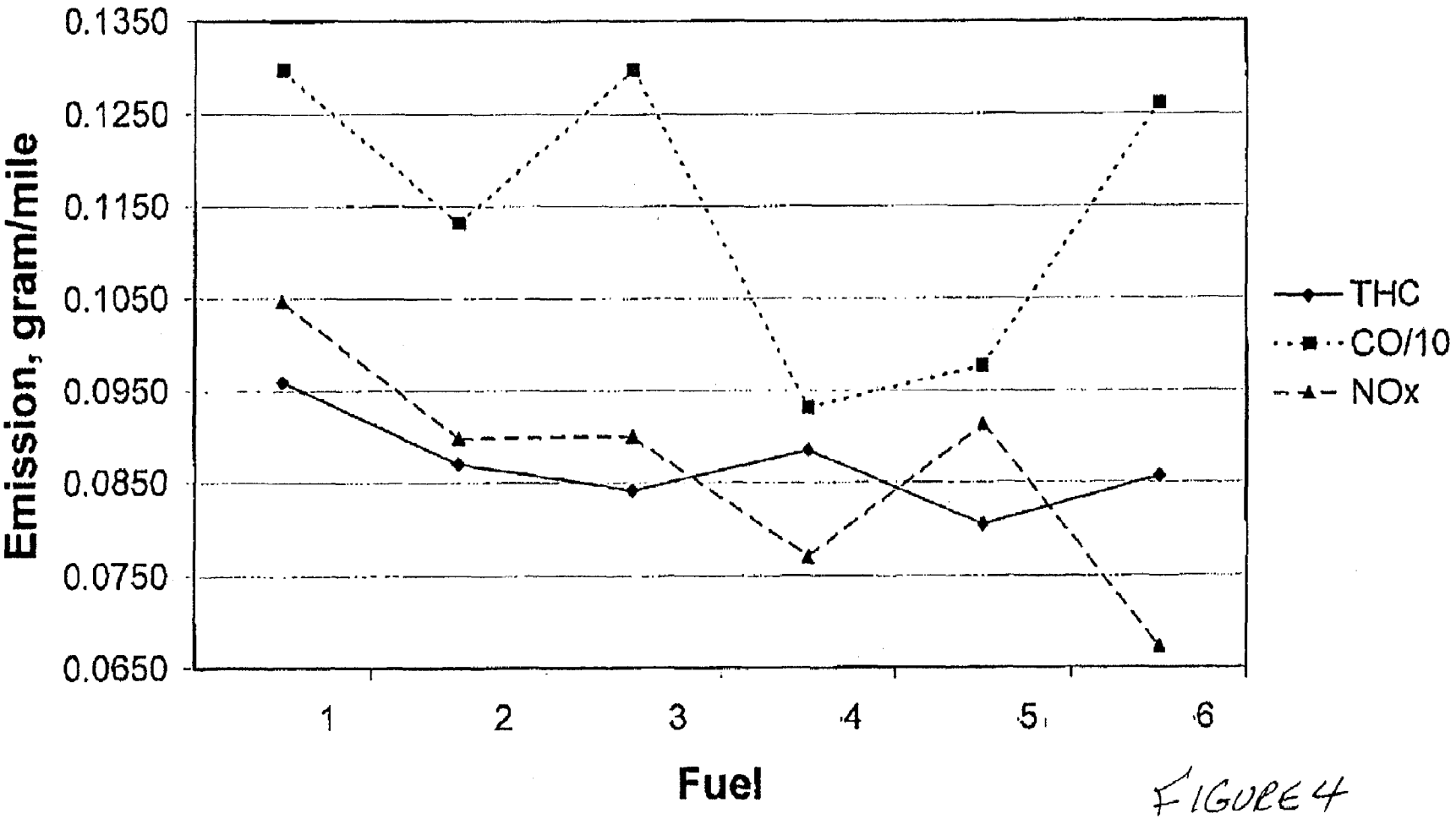
FIG. 4 shows the fleet average emissions for each of the fuels tested for total hydrocarbons, carbon monoxide, and nitrogen oxides.

Table 3 and FIGS. 1, 2, and 3 show the averages of these results for each fuel/vehicle combination. The fleet average emissions (i.e., each emission averaged over the three vehicles) are shown in FIG. 4. In addition, duplicate FTP tests were run on fuels 7 and 8 using only the 1998 Honda Accord. The individual vehicle test results are included in Table 2 and the trends with lower octane fuels are shown in FIGS. 1, 2, and 3.

TABLE 3

| Average Emission Test Results | | | | |
|---|---|---|---|---|
| | | AVERAGE EMISSIONS* | | |
| Vehicle | Fuel | THC | CO | NOx |
| Ford Explorer | 1 | 0.0845 | 1.1410 | 0.0375 |
| Ford Explorer | 2 | 0.0820 | 0.9180 | 0.0375 |
| Ford Explorer | 3 | 0.0805 | 1.0520 | 0.0295 |
| Ford Explorer | 4 | 0.0890 | 0.8770 | 0.0295 |
| Ford Explorer | 5 | 0.0840 | 1.0640 | 0.0370 |

TABLE 3-continued

Average Emission Test Results

| Vehicle | Fuel | AVERAGE EMISSIONS* THC | CO | NOx |
|---|---|---|---|---|
| Ford Explorer | 6 | 0.0880 | 1.0625 | 0.0230 |
| Honda Accord | 1 | 0.0990 | 2.1870 | 0.1225 |
| Honda Accord | 2 | 0.0740 | 1.6730 | 0.0805 |
| Honda Accord | 3 | 0.0845 | 2.2000 | 0.0955 |
| Honda Accord | 4 | 0.0875 | 1.5110 | 0.0885 |
| Honda Accord | 5 | 0.0675 | 1.3395 | 0.1070 |
| Honda Accord | 6 | 0.0790 | 2.0455 | 0.0685 |
| Honda Accord | 7 | 0.0905 | 2.1515 | 0.0745 |
| Honda Accord | 8 | 0.0785 | 1.7725 | 0.0995 |
| Dodge Caravan | 1 | 0.1045 | 0.5655 | 0.1540 |
| Dodge Caravan | 2 | 0.1050 | 0.8015 | 0.1515 |
| Dodge Caravan | 3 | 0.0875 | 0.6410 | 0.1450 |
| Dodge Caravan | 4 | 0.0890 | 0.4075 | 0.1130 |
| Dodge Caravan | 5 | 0.0900 | 0.5280 | 0.1300 |
| Dodge Caravan | 6 | 0.0900 | 0.6760 | 0.1105 |

*ALL EMISSIONS VALUES ARE SHOWN IN GRAMS PER MILE

The fleet average total hydrocarbon emissions and the carbon monoxide emissions for all of the low sulfur, low octane gasolines (fuels 2-5) were either less, or not significantly different, than either the lower sulfur (less than 5 ppmw) or the higher sulfur (70 ppmw) 87 minimum octane gasolines. This is unexpected in that the low octane gasoline would be expected to cause knock, which is auto ignition induced combustion. Such auto ignition combustion could cause fuel/air mixture inhomogeneities that would increase the carbon monoxide and total hydrocarbon emissions during the cold phase of the test and increase local temperatures and pressures that would increase NOx. For NOx the lower sulfur 87 minimum octane gasoline (fuel 6) had the lowest emission level and the higher sulfur 87 minimum octane gasoline (fuel 1) had the highest emission level while the lower octane gasolines had emissions between the two.

Further tests were conducted with fuel 5. This fuel contained 2% oxygen (as ethanol) but otherwise was substantially the same as fuel 2. Basically, fuel 5 was produced to be the same as fuel 2 except that ethanol was added and isomerate was removed to keep the vapor pressure constant. The ethanol fuel (fuel 5) fleet average CO emissions were significantly less than fuel 2 but its total hydrocarbon and NOx emissions were not significantly different. In additional tests run with the Honda Accord, using fuels of varying sulfur content, it was determined, that with this particular engine, the general trend is increasing CO emissions with increasing octane, lower carbon monoxide with the inclusion of ethanol, lower carbon monoxide with higher 90% distillation temperatures, with relatively small effects of sulfur and its interaction as a function of the octane.

For total hydrocarbon emissions a general trend of increasing total hydrocarbon emissions with increasing octane level was noted. Statistically, there appears to be an interaction between sulfur and the octane level. Practically, this can be interpreted as the sulfur having a different effect on low octane gasoline compared to high-octane gasoline. Only the 37 parts per million sulfur, low octane gasoline was observed to make statistically higher total hydrocarbons emissions than the 5 parts per million 87 minimum octane fuel. Inclusion of the octane/sulfur interaction in the statistical analysis results in confirmation of increasing total hydrocarbon emissions with increasing octane.

A statistical analysis of the data indicated a large interaction between the octane and sulfur content with respect to NOx emissions. It was also concluded that NOx increases as the octane increases. Ethanol appeared to statistically increase the amount of NOx emissions. It appears that all of the values for NOx emission for the low octane fuels fell between the two 87 octane fuels, one of which had a high sulfur content and the other of which had a low sulfur content. It appears that the NOx emissions from the lower octane fuels are not substantially different than the California Phase 2 gasolines (Fuels 1 and 6).

In FIG. 1, the carbon monoxide emissions for the various fuels for the various vehicles tested are shown. In FIG. 2 the total hydrocarbon emissions are shown, in FIG. 3 the nitrogen oxide emissions are shown and in FIG. 4 the fleet average emissions are shown.

In view of this data it appears that reducing the octane level of gasoline has no detrimental effects and that reducing the octane results in reduced emissions from the engines tested with the fuels tested. Accordingly, it appears that reducing the octane level of a gasoline has beneficial results with respect to the reduction of emissions upon combustion of the gasoline in an internal combustion automotive engine. Such fuels can be produced readily in compliance with all federal, state, local, and California gasoline requirements unless octane is a regulated property in a particular state or local specification. Accordingly, this improvement in emissions can readily be achieved. While greatest improvements are achieved by reduction of the octane in combination with the use of low sulfur containing gasolines it is also desirable that an oxygenate be included to reduce carbon monoxide emissions and for regulatory compliance. It also appears that the ethanol reduces the CO emissions upon the combustion of the gasoline.

As further discussed above, it appears that the amount of carbon dioxide emission from the refinery wherein the gasoline is produced can be greatly reduced while increasing the volume of gasoline from a given feedstock. It further appears that natural gas or other fuels may be conserved by production of gasoline having an octane value less than 87.

In total it appears that the gasoline of the present invention can be produced by a refinery, which can operate at lower emission conditions and more efficient conditions in that it produces a greater quantity of gasoline from a given quantity of feedstock with reduced emissions. It has been shown that the gasoline of the present invention when combusted in internal combustion engines results in reduced emissions by comparison to currently available standard gasolines. This is surprising and unexpected in view of the widely established practice of requiring an octane of 87 minimum for regular and a minimum octane of at least 91, and more typically 92 for premium.

Having thus described the invention by reference to its preferred embodiments it is respectfully pointed out that the embodiments described are illustrative rather than limiting in nature and that many variations and modifications are possible within the scope of the present invention.

Having thus described the invention we claim:

1. An unleaded low emissions gasoline fuel for use in an internal combustion automotive engine, said gasoline fuel being in compliance with California reformulated gasoline specifications and having an unadjusted octane (R+M)/2 of from 80 to 84 or the equivalent adjusted octane number which upon combustion in the internal combustion automotive engine produces emissions of at least one of total hydrocarbons, carbon monoxide and nitrogen oxides no greater than produced by combustion of a comparable unleaded minimum 87 octane gasoline fuel, wherein the comparable unleaded minimum 87 octane gasoline fuel is in compliance with California reformulated gasoline fuel specifications.

2. An unleaded reduced emissions gasoline fuel for use in an automotive internal combustion engine containing a selected quantity of an oxygenate selected from the group consisting of ethanol, methyl tertiary butyl ether, ethyl tertiary butyl ether, tertiary amyl methyl ether, and combinations thereof and having an unadjusted octane (R+M)/2 of from 80 to 84 or the equivalent adjusted octane number which, upon combustion in the internal combustion engine, produces reduced emissions of at least one of total hydrocarbons, carbon monoxide and nitrogen oxides by comparison to combustion of a comparable unleaded minimum 87 octane gasoline fuel in the internal combustion engine and wherein the unleaded reduced emissions gasoline fuel is in compliance with California reformulated gasoline fuel specifications.

3. The unleaded reduced emissions gasoline fuel of claim 2 wherein the comparable unleaded minimum 87 octane gasoline fuel is in compliance with California reformulated gasoline fuel specifications.

4. The unleaded reduced emissions gasoline fuel of claim 2 having a sulfur content less than 40 ppmw.

5. The unleaded reduced emissions gasoline fuel of claim 4 wherein the comparable unleaded minimum 87 octane gasoline fuel is in compliance with California reformulated gasoline fuel specifications.

6. The unleaded reduced emissions gasoline fuel of claim 4 wherein the emissions of carbon monoxide are reduced.

7. The unleaded reduced emissions gasoline fuel of claim 4 wherein the comparable unleaded minimum 87 octane gasoline fuel is in compliance with California reformulated gasoline fuel specifications.

8. The unleaded reduced emissions gasoline fuel of claim 4 wherein the quantity of oxygenate is sufficient to provide from about 0.1 to about 10 weight percent oxygen.

9. The unleaded reduced emissions gasoline fuel of claim 4 wherein the oxygenate is ethanol and is present in an amount from 0.1 to 10 volume percent of the gasoline fuel.

10. The unleaded reduced emissions gasoline fuel of claim 8 wherein at least the emissions of total hydrocarbons and carbon monoxide are reduced.

11. A method for fueling automotive vehicles with reduced total emissions to the atmosphere, the method comprising:

a) operating a refinery to produce an unleaded reduced emissions gasoline fuel having an unadjusted octane (R+M)/2 of from 80 to 84 or the equivalent adjusted octane number which upon combustion in an automotive vehicle internal combustion engine produces reduced emissions of at least one of total hydrocarbons, carbon monoxide and nitrogen oxides by comparison to that produced by combustion of a comparable unleaded minimum 87 octane gasoline fuel, the unleaded reduced emissions gasoline fuel being produced in the refinery from a reduced quantity of feedstock and with reduced emissions by comparison to a refinery producing the comparable unleaded minimum 87 octane gasoline fuel; and, b) fueling automotive vehicles with the unleaded reduced emissions gasoline fuel, the total emissions of at least one of total hydrocarbons, carbon monoxide, and nitrogen oxides from combustion of the unleaded reduced emissions gasoline fuel in the automotive vehicles and from the refinery producing the unleaded reduced emissions gasoline fuel being less than the combined emissions from a refinery producing the comparable unleaded minimum 87 octane gasoline fuel and combustion of the comparable unleaded minimum 87 octane gasoline fuel in the automotive vehicles, wherein the unleaded reduced emissions gasoline fuel is in compliance with California reformulated gasoline fuel specifications and ASTM 4814-01a.

12. The method of claim 11 wherein the comparable unleaded minimum 87 octane gasoline fuel is in compliance with California reformulated gasoline fuel specifications and ASTM D4814-01a.

13. The method of claim 11 wherein the unleaded reduced emissions gasoline fuel has a sulfur content of less than about 40 ppmw sulfur.

14. The method of claim 11 wherein the unleaded reduced emissions gasoline fuel has a sulfur content of less than about 15 ppmw sulfur.

15. The method of claim 11 wherein the unleaded reduced emissions gasoline fuel has a sulfur content of less than about 5 ppmw sulfur.

16. The method of claim 11 wherein the unleaded reduced emissions gasoline fuel employed in step (b) additionally contains an amount of oxygenate selected from the group consisting of ethanol, methyl tertiary butyl either, ethyl tertiary butyl ether, tertiary amyl methyl ether, and combinations thereof.

17. An unleaded gasoline fuel for use in an automotive internal combustion engine, said gasoline fuel having an unadjusted octane number (R+M)/2 in the range of from 80 to 84 or the equivalent adjusted octane number, and being in accord with the CARB Phase 2 reformulated gasoline fuel specifications except that the T-90 of said gasoline fuel exceeds the CARB Phase 2 reformulated gasoline fuel specifications and the oxygen content of said gasoline fuel is in the range of from about 0 to 10 wt %.

18. The gasoline fuel of claim 17 having a sulfur content less that 15 ppmw.

19. The gasoline fuel of claim 17 having a sulfur content less than 10 ppmw.

20. The gasoline fuel of claim 17 having a sulfur content less than 5 ppmw.

21. The gasoline fuel of claim 17 wherein the oxygen content is provided by one or more compounds selected the group consisting of ethanol, methyl tertiary butyl ether, ethyl tertiary butyl ether, and tertiary amyl methyl either.

22. The gasoline fuel of claim 21 having an oxygen content in the range of 0.3-5 wt %.

23. The gasoline fuel of claim 21 having an oxygen content in the range of 2.0-5.0 wt %.

24. The gasoline fuel of claim 1 wherein the upper limit of the range of unadjusted octane (R+M)/2 is 83.

25. The gasoline fuel of claim 2 wherein the upper limit of the range of unadjusted octane (R+M)/2 is 83.

26. The gasoline fuel of claim 11 wherein the upper limit of the range of unadjusted octane (R+M)/2 is 83.

27. The gasoline fuel of claim 17 wherein the upper limit of the range of unadjusted octane (R+M/2 is 83.

* * * * *